US006500281B2

(12) United States Patent
Kurosaki

(10) Patent No.: US 6,500,281 B2
(45) Date of Patent: Dec. 31, 2002

(54) FE-NI ALLOY MATERIAL USED FOR SHADOW MASK HAVING IMPROVED FORMABILITY OF THROUGH-HOLES BY ETCHING

(75) Inventor: Ikuya Kurosaki, Ibaraki (JP)

(73) Assignee: Nippon Mining & Metals Co., Ltd., Minato-ku (JP)

( * ) Notice: Subject to any disclaimer, the term of this patent is extended or adjusted under 35 U.S.C. 154(b) by 0 days.

(21) Appl. No.: 09/905,901

(22) Filed: Jul. 17, 2001

(65) Prior Publication Data

US 2002/0039693 A1 Apr. 4, 2002

(30) Foreign Application Priority Data

Jul. 17, 2000 (JP) ..... 2000-215644

(51) Int. Cl.[7] ..... C22C 38/08

(52) U.S. Cl. ..... 148/336; 148/330; 420/94; 420/98

(58) Field of Search ..... 420/94, 98; 148/336, 148/330

(56) References Cited

U.S. PATENT DOCUMENTS 5,916,380 A * 6/1999 Yuki et al. ..... 420/94
5,958,331 A * 9/1999 Mizuguchi et al. ..... 420/94
2001/0047839 A1 * 12/2001 Hatano et al. ..... 402/94

* cited by examiner

*Primary Examiner*—Deborah Yee
(74) *Attorney, Agent, or Firm*—Birch, Stewart, Kolasch & Birch, LLP

(57) ABSTRACT

In the production or a shadow mask, the through-holes for passing an electron beam are formed by etching of the Fe—Ni alloy. The variation in diameter of apertures is prevented by dispersing 2000 or more of precipitates and inclusions from 0.01 $\mu$m to 5 $\mu$m in diameter on the surface of said material per mm$^2$. The Fe—Ni alloy of from 34 to 38% of Ni, not more than 0.5% of Mn, and if necessary, from 5 to 40 ppm of B, and from 5 to 40 ppm of N, the balance being Fe and unavoidable and incidental impurities with the proviso of 0.10% or less of C, 0.30% or less of Si, 0.30% or less of Al, 0.005% or less of S, and 0.005% or less of P.

2 Claims, 3 Drawing Sheets

FE-NI ALLOY MATERIAL USED FOR SHADOW MASK HAVING IMPROVED FORMABILITY OF THROUGH-HOLES BY ETCHING

BACKGROUND OF INVENTION

1. Field of Invention

The present invention relates to an Fe—Ni alloy material used for a shadow mask subjected to fine etching. More particularly, the present invention relates to an Fe—Ni alloy material used for a shadow mask, which enables through-holes for passing an electron beam to be formed by etching, having improved uniformity of diameter. The present invention relates to the Fe—Ni alloy material used for a shadow mask, having etched through-holes with improved uniformity of diameter.

2. Description of Related Art

Heretofore, mild steel has been generally used for the shadow mask of a CRT. However, when the CRT is continuously operated, the temperature of the shadow mask rises due to the radiation of an electron beam. As a result of thermal expansion of the shadow mask, coincidence of the fluorescent material and the irradiation point of an electron beam is not maintained, thereby resulting in color deviation. When the color image tube is operated, one third or less of the electron beam passes through the apertures, while the rest of the electron beam is irradiated and impinged on the shadow mask, elevating its temperature.

Accordingly, Fe—Ni alloy having a small coefficient of thermal expansion, referred to as "36 Alloy" has been used in recent years from the viewpoint of color deviation in the field of a shadow mask used for a CRT.

In the production process of the Fe—Ni alloy shadow-mask material, a predetermined Fe—Ni alloy is vacuum-melted, for example, in a VIM furnace or ladle-refined in LF, and then cast into an ingot. The alloy is forged and then hot-rolled into a slab. The oxide scale on the surface of the slab is removed. Cold-rolling and annealing (recrystallizing annealing) are repeated. After the final annealing, the final cold-rolling is carried out to finish the sheet to a predetermined thickness, i.e., 0.3 mm or less. Thereafter, slitting is carried out to a predetermined width. After degreasing of the so-produced material for a shadow mask, photoresist is applied on both surfaces of the material. A pattern is printed on the photoresist and then developed. The etching is then carried out with an etchant. The material is then cut into separate flat masks. The flat masks are annealed in non-oxidizing atmosphere so as to impart press formability. In the case of the pre-annealing method, the annealing is applied to the finally rolled material prior to the etching. Pressing into a spherically shape is carried out. Finally, the spherically-shaped mask is degreased and is then subjected to blackening treatment in steam or combustion-gas atmosphere to form a black oxide film on the surface. The shadow mask is produced as above.

The finally cold-rolled material, which is or has been subjected to etching for forming the through-holes for passing an electron beam, is herein collectively referred to as the material used for a shadow mask. The flat mask is, therefore, included in the material used for a shadow mask. The material, on which the through-holes have been formed, but which is not yet press-formed, is also included in the material used for a shadow mask.

The through-holes for passing an electron beam are formed in the shadow mask by means of the well known etching usually using a ferric chloride aqueous solution. Before the etching, the well known photolithography technique is applied in such a manner that the photoresist mask is delineated to form a number of apertures in the circular form having, for example, 80 $\mu$m of diameter on one of the surfaces of the alloy strip and to form a number of apertures in the circular form having, for example, 180 $\mu$m of diameter on the coincident positions of the other surface of the alloy strip. The aqueous-solution of ferric chloride in the form of spray is blown onto the alloy strip.

The shadow mask, on which minute apertures are densely arranged, is obtained by the etching mentioned above. Local variation in etching conditions results in deviation of the diameter of apertures. When such variation becomes excessive, color shift occurs in a Braun tube mounting such shadow mask. Such mask is, therefore, unacceptable. In the production of shadow masks, the yield has heretofore been lowered and hence the cost has been increased due to variation of the aperture diameter.

Various considerations have heretofore been made to improve the etching formability of through-holes. Japanese Unexamined Patent Publication No. 05-311357 is related to improvement of the material and proposes to control the texture degree of the {100} plane on the rolling plane to less than 35% and hence randomize the crystal orientation. Japanese Unexamined Patent Publication No. 5-311358 describes to limit the total length of inclusions in the rolling direction per unit area of the parallel cross-section to the rolling direction. In addition, Japanese Unexamined Patent Publication No. 7-207415 describes that the etching formability of through-holes is improved by means of limiting the Mn and S concentrations as well as the Si and C concentrations, and also by controlling the cleanliness of the oxide-based inclusions of the cross section of the material.

The present inventors carried out intensive research and discovered that the local etching failure of through-holes for passing the electron beam described below cannot be prevented by means of controlling the texture and limiting the inclusions. Excessive etching of the apertures as compared with the neighboring apertures may occur, resulting in etching failure. As a result of the failure in local etching, the diameter of through-holes for passing an electron beam varies. This etching failure discovered by an inventor is a phenomenon that, when the shadow mask, in which the through-holes for passing an electron beam has been formed by means of etching, is observed in such a manner that an observer sees the light through the mask, the vicinity of apertures appears light and shines. FIG. 1 is an enlarged drawing of a normal aperture, while FIG. 2 is an enlarged view of an abnormal aperture. When the wall of the normal and abnormal apertures are observed, the inclination angle of the wall is seen smaller in the abnormal aperture (FIG. 4) than that of the normal aperture (FIG. 3). Because of very local etching failure around the periphery of an abnormal aperture, the aperture diameter tends to be greater than the target value.

SUMMARY OF INVENTION

It is an object of the present invention to provide an Fe—Ni alloy material, which has through-holes formed by etching, without variation of the diameter which is attributable to local etching failure of the Fe—Ni alloy material during etching to form through-holes for passing an electron beam.

The present inventors carried out intensive research to attain the object mentioned above from a novel point of view not found in the prior art, particularly the reasons for the local corrosion anomaly mentioned above. As a result, it is found that fine precipitates and inclusions present in the Fe—Ni alloy material exert great influence upon the etching of through-holes for passing the electron beam. Such local etching failure and hence the diameter variation of etched apertures are difficult occur in the Fe—Ni alloy material, in which a large number of fine precipitates and inclusions are present in the material as a whole. It was found that, when the precipitates and inclusions from 0.01 $\mu$m to 5 $\mu$m in size are present on the surface of material at a frequency of 2000 or more per $mm^2$, the precipitates and inclusions are effective for suppressing the above mentioned variation.

The components of the precipitates and inclusions were identified. The identified precipitates and inclusions are nitrides such as BN, TiN, AlN and the like, oxides such as MnO, MgO, CaO, TiO, $Al_2O_3$, $SiO_2$ and the like, sulfides such as MnS, CaS, $MgS_2$ and the like, and carbides such as TiC, SiC and the like. When a sample is immersed in the acidic solution such as dilute hydrochloric acid, dilute sulfuric acid solution, and the sample is anodically dissolved in the acidic solution at a potential in an active dissolving region, the particles of precipitates and inclusions appear in the form of pits (pitting corrosion). The frequency of the particles of precipitates and inclusions can be evaluated as the pit density in number per $mm^2$.

It is not precisely elucidated how the minute inclusions or precipitates can suppress variation of the diameter of etching apertures. It can be postulated as follows.

The Fe—Ni alloy, to which the present invention relates, is usually etched by means of a ferric chloride-containing aqueous solution to form the through-holes for passing an electron beam. During the etching, resist film is applied on the material, where no apertures are to be formed, while the portions of the material, where the apertures are to be formed, are brought into the ferric chloride aqueous solution. When the minute inclusions or precipitates (hereinafter collectively referred to as the inclusions, unless otherwise specified) are present on the latter portions, the inclusions behave as the origin of corrosion, thereby promoting corrosion of the matrix. If no inclusions are present on the aperture portions at all, all of these portions undergo identical etching so that the diameter of apertures does not vary. However, it is difficult in the actual industrial production to provide a completely inclusion-free material. Inclusions are thus present on several aperture portions in a certain probability. The etching rate in the first aperture portions, where the origins of corrosion are present, is higher than that in the second aperture portions in the neighborhood of the first aperture portions, where no origins of corrosion are present. The aperture-diameter of the first aperture portions is greater than that of the second aperture portions. The first aperture portions become electrochemically anode, while the second aperture portions become electrochemically cathode. The difference in the etching rate between the first and second aperture portions is further increased. At the completion of etching, the difference between the aperture diameters is, therefore, great.

On the other hand, when fine inclusions are present in the material at a certain frequency, the inclusions can be present uniformly in all aperture portions. The diameter of apertures then does not vary.

As a result of the elucidation mentioned above, it can be said as follows. When the inclusions, which are the origin of corrosion, are present at a frequency less than a certain level, the uniform distribution of inclusions on the entire material is lost. There are following aperture portions. In most of aperture portions, the inclusions are present and are related to the corrosion. The degree of relation is in average in these aperture portions. The inclusions are not related to corrosion in other aperture portions. The inclusions are related to corrosion in a degree higher than the average one in still other aperture portions. The relation of inclusions and corrosion in all of these aperture portions is different from one another. The corrosion rate in these aperture portions is different from one another. The wall, profile and diameter of apertures are influenced by the different etching rate. The local etching failure occurs on the wall, profile and diameter of apertures formed by etching under different rates. The local etching failure and hence the diameter variation of the etched through-hole can be observed under an electron microscope. The presence of inclusions can be confirmed as the pits mentioned above. The inclusions and the pits are present in ratio of almost 1: 1.

As is described hereinabove, more than certain numbers of fine inclusions are positively introduced in the matrix of Fe—Ni alloy in the present invention. This measure is contrary to the conventional concept. The local etching failure is eliminated by such inclusions and the variation of the aperture—diameter is eliminated or lessened.

In accordance with the objects of the present invention, there is provided a material used for a shadow mask having improved uniformity in the diameter of apertures formed when etching the through-holes for passing an electron beam, wherein said material is an Fe—Ni alloy consisting of, by mass percentage (%), (hereinafter simply referred to as the mass %) from 34 to 38% of Ni, not more than 0.5% of Mn, and if necessary, from 5 to 40 ppm of B and from 5 to 40 ppm of N, the balance being Fe and unavoidable and incidental impurities with the proviso of 0.10% or less of C, 0.30% or less of Si, 0.30% or less of Al, 0.005% or less of S, and 0.005% or less of P, characterized in that 2000 or more of precipitates and inclusions from 0.01 $\mu$m to 5 $\mu$m in diameter are varied on the surface of said material per $mm^2$ of said surface.

The diameter of inclusions is the diameter of the smallest circle, in which an inclusion is included.

There is also provided a post-etched material. That is, material used for a shadow mask having through-holes for passing an electron beam formed by etching, with improved uniformity in the diameter of apertures formed, consists of an Fe—Ni alloy consisting of, by mass percentage (%), from 34 to 38% of Ni, not more than 0.5% of Mn, and, if necessary, from 5 to 40 ppm of B and from 5 to 40 ppm of N, the balance being Fe and unavoidable and incidental impurities with the proviso of 0.10% or less of C, 0.30% or less of Si, 0.30% or less of Al, 0.005% or less of S, and 0.005% or less of P, characterized in that 2000 or more of precipitates and inclusions from 0.01 $\mu$m to 5 $\mu$m in diameter are varied on the surface of said material per $mm^2$ of said surface, except for the portions where said through-holes are formed.

In the Fe—Ni alloy material according to the present invention, the Ni content is limited in a range of from 34 to 38%. When the Ni content falls outside this range, the coefficient of thermal expansion becomes so great that the Fe—Ni alloy cannot be used as a shadow mask. The detrimental effects of S, which impairs the hot-workability, is eliminated by Mn added to iron alloy. However, when the Mn content exceeds 0.5%, the material is excessively hardened and the workability is impaired. The highest content of Mn content is, therefore, limited to 0.5%.

The Fe—Ni alloy material contains as impurities or incidental impurities C, Si, Al and P. The upper limits of C, Si, Al and P are limited to 0.10%, 0.30%, 0.30% and 0.005%, respectively. When the concentrations of these elements are more than a certain level, the etching formability of through-holes is so impaired that the material cannot be used for a shadow mask. When the S content is more than 0.005%, the hot workability of material is seriously impaired. The highest content of S is, therefore, limited to 0.005%.

In addition, from 5 to 40 ppm of B and from 5 to 40 ppm of N are contained for the purpose of introducing fine BN particles.

BRIEF DESCRIPTION OF DRAWINGS

FIG. 5(*b*) is a schematic drawing of the through-holes formed by etching, having varied diameter.

PREFERRED EMBODIMENTS OF INVENTION

Figure 5:
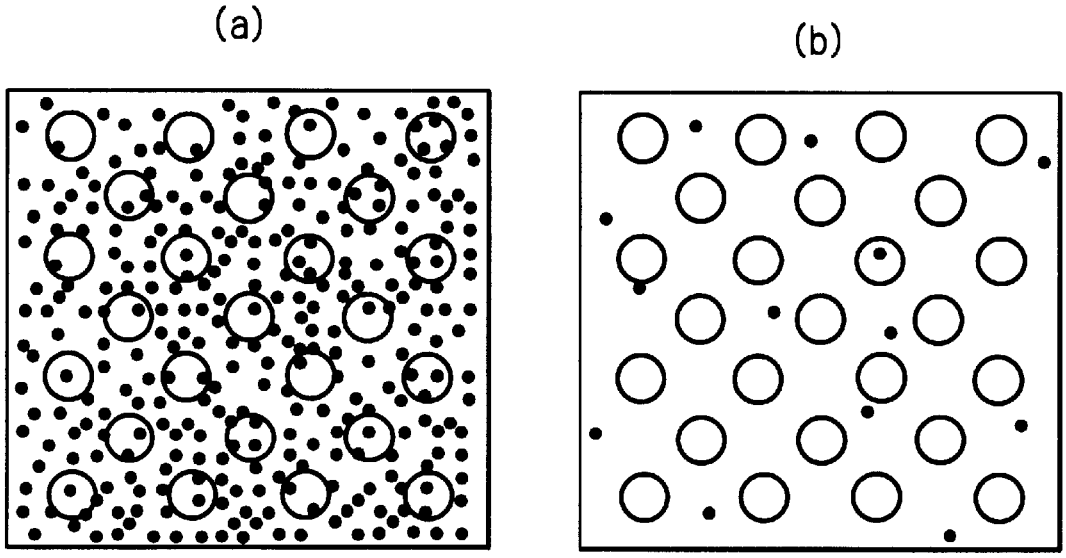
FIG. 5(*a*) is a schematic drawing of the through-holes formed by etching, having varied diameter. Number of pits (pitting corrosion) is different from that of FIG. 5(*b*).

When the material contains inclusions at a frequency higher than a certain level as shown in FIG. 5(*a*), the inclusions are uniformly present on every aperture portion. The apertures and the diameter of the apertures do not vary on every aperture portion during the etching. However, the frequency of inclusions is less than a certain level as shown in FIG. 5(*b*). In the case of FIG. 5(*b*), the relationship of corrosion and inclusions which is slight in several aperture portions, is noticeable in several other aperture portions. Local corrosion failure due to different relationship between the corrosion and inclusions therefore occurs, resulting in variation of the diameter of the etched through-holes. Such variation of the diameter occurs on the apertures as a whole.

Regarding the observation of impurities, 20 g/L of hydrochloric-acid solution was used. The anodic solution was carried out at +250 mV relative to the standard hydrogen electrode. MnS among the inclusions was dissolved under the anodic solution, and hence could not be analyzed. The density of inclusions was obtained by counting the number of the pits from 0.01 $\mu$m to 5 $\mu$m in diameter by SEM.

The inclusions behave as an origin of corrosion. When the inclusions are present in the material as a whole at a frequency higher than a certain value, they are effective for suppressing the variation of the diameter of the through-holes. Only the inclusions having a diameter of 0.01 to 5 $\mu$m have the effects mentioned above. The effect is realized when the number of such inclusions is 2000 or more per $mm^2$ of the surface of the material. The inclusions smaller than 1 $\mu$m of diameter are too small to behave as the origin of corrosion. On the other hand, the inclusions coarser than 5 $\mu$m impair the etching. Usually, it is preferred that from 2500 to 20000 inclusions are per $mm^2$.

In the production method of Fe—Ni alloy described hereinabove, the thickness of Fe—Ni alloy material used as the shadow mask is from 0.01 to 0.3 mm. This sheet is finished by subjecting a 2–6 mm thick hot-rolled sheet to repeated cold rolling and recrystallizing annealing and then the final recrystallizing annealing and the final cold rolling. The steps, which contribute to the formation of inclusions, in these successive production steps, are the hot-rolling and annealing. It is necessary to optimize the heat history of the material in the hot-rolling and recrystallizing annealing, in order to introduce fine precipitate-based inclusions in the Fe—Ni alloy. The annealing, which does not induce the recrystallization, for example aging treatment and stress-relief annealing, may be carried out.

Although neither solution nor precipitation of the precipitate-based inclusions occurs during the cold-rolling, the working degree of cold-rolling influences such solution and precipitation. This factor should be considered.

① Hot Rolling The Fe—Ni alloy is hot rolled usually at a temperature range of from 950 to 1250° C. The precipitate-based inclusions are dissolved in the matrix in the temperature range mentioned above. Subsequent to the completion of hot rolling, a hot-rolled sheet is slowly cooled. Fine precipitate-based inclusions are formed during the cooling step. Precipitation of most of the precipitate-based inclusions occurs at a temperature of 900° C. or less. When the temperature falls lower than 700° C., the precipitating speed lowers. Appropriate slow-cooling temperature-range is, therefore, from 900 to 700° C.

② Recrystallizing Annealing: There are two methods, i.e., the annealing may be carried out at high temperature for a short period of time using a continuous annealing line, and, the annealing may be carried out at low temperature for an extended period of time using a batch annealing furnace. In any case, the furnace interior must be filled with hydrogen gas or inert gas which contains hydrogen gas. The size of post-annealing recrystallized grains should be adjusted to 5–30 $\mu$m in average diameter. The average diameter of crystal grains is measured according to the cutting method described in Japan Industrial Standard JIS H0501 with regard to the cutting section parallel to the rolling direction. The structure is made discernible by means of mechanically finishing the observed surface to a mirror finish, and dipping a sample in the nitric acid-acetic acid solution. When the post-annealed grain size is more than 30 $\mu$m, the wall of through-holes formed is disadvantageously roughened by etching and the etching rate lowers. In addition, when the crystal grains are coarser than 30 $\mu$m after the recrystallizing annealing, the finally annealing structure becomes non-uniform. That is, coarse grains and fine grains are mixed after the final annealing. In this case, the wall of through-holes is rough, and the etching speed is non-uniform. When the diameter of crystal grains is less than 5 $\mu$m, such problems as follows are incurred. It is difficult to uniformly control the diameter of the crystal grains. In addition, the cold-rolling workability, required in the subsequent step, is lowered.

The hot-rolling and recrystallizing annealing may be carried out under optional conditions. However, after the final rolling, the annealing is carried out under such a condition that no recrystallization occurs but the precipitation is promoted.

③ Working Degree of Final Cold Rolling: When the working rate exceeds 40%, the rolling texture develops, so that the etching speed is lowered. On the other hand, when the working degree is less than 10%, and when the annealing is carried out directly before the pressing so as to impart press formability, un-recrystallized grains remain so that the press formability is lowered.

The hot-rolling and cold-rolling steps under the conditions described above enable Fe—Ni alloy material to be produced, which does not cause the local etching failure and hence variation of the aperture diameter, when the through-holes for passing an electron beam are formed by etching.

When the Fe—Ni alloy material produced as above is etched to form the through-holes for passing an electron beam, they elongate across the matrix of the material, in which a number of the inclusions are varied. The diameter of the etched through-holes for passing an electron beam does not vary and has improved uniformity over the conventional material used for a shadow mask.

EXAMPLES

The Ni concentration and concentration of impurities (incidental elements) were adjusted to: 35.8–36.5% of Ni, 0.2–0.5% of Mn, 0.02–0.3% of Si, 0.0005–0.005% of S, 0.01–0.3% of Al, 0.001–0.1% of C, 0.001–0.003% of P and 5–40 ppm of B and 5 to 40 ppm of B. The ingot was hot-forged and then hot-rolled. The oxide scale on the surface of the hot-rolled material was then removed. The cold rolling and recrystallizing annealing were then repeated. The final cold-rolling was to reduce the thickness to 0.2 mm. As a result of these steps, an alloy strip was produced. The composition of ingots, melting method and conditions of subsequent cold-rolling as well as the heat treating methods were varied within the embodiments mentioned above, so as to vary the amount of inclusions and precipitates.

Table 1 shows the analysis result of inclusions on the corrosion origins with regard to the materials produced by the following steps ①~③. It is estimated that such precipitates as BN and such inclusions as $Al_2O_3$ are present in the corrosion origins.

① In the hot-rolling step as described above, a slab was worked in a temperature range of from 950° C. to 1250° C. to reduce thickness to 3–6 mm. The average cooling speed in the subsequent cooling step was set at 0.5° C./second or less. However, the average cooling speed of the failed product in Table 2, below was 0.7 m/second.

② In all products, the temperature of recrystallizing annealing was adjusted to 850° C. to 1100° C., and the strips were continuously conveyed through a heating furnace, in which hydrogen gas or hydrogen-containing inert gas was filled. The average size of the recystallized grains were thus adjusted to 5 to 30 μm.

③ The reduction ratio of the cold-rolling prior to the final recrystallizing annealing was adjusted to 50 to 85%. The working degree of the final cold rolling was adjusted to 10–40%.

TABLE 1

| | B | N | Mg | Al | Si | S | Ca | Cr | O |
|---|---|---|---|---|---|---|---|---|---|
| 1 | ◎ | ◎ | ○ | ○ | ○ | ○ | | ○ | ○ |
| 2 | | ◎ | ○ | ◎ | | | Δ | | ◎ |
| 3 | ◎ | ◎ | Δ | Δ | Δ | Δ | Δ | | |
| 4 | | | ○ | ◎ | | ◎ | ◎ | | ◎ |
| 5 | ◎ | ◎ | Δ | ○ | Δ | Δ | | Δ | ◎ |
| 6 | | ◎ | | ◎ | | | | ○ | |
| 7 | | ◎ | | ◎ | | ○ | | | ◎ |
| 8 | | | ◎ | ○ | ○ | ◎ | ○ | | ◎ |
| 9 | | | ◎ | ◎ | Δ | ○ | ○ | | ◎ |
| 10 | | ◎ | ○ | ◎ | | ○ | Δ | ○ | ◎ |
| 11 | | | ◎ | ◎ | ○ | | | ◎ | ◎ |
| 12 | | ◎ | ◎ | ◎ | | | | ○ | ◎ |
| 13 | | ◎ | ○ | ◎ | Δ | ○ | ○ | ◎ | ◎ |
| 14 | | | | ◎ | ○ | ○ | ◎ | ◎ | ◎ |

TABLE 1-continued

| | B | N | Mg | Al | Si | S | Ca | Cr | O |
|---|---|---|---|---|---|---|---|---|---|
| 15 | | | ◎ | ◎ | | ○ | | ◎ | ◎ |
| 16 | | | | ◎ | ◎ | | ◎ | ◎ | ◎ |
| 17 | | ◎ | | ◎ | Δ | Δ | ○ | ◎ | ◎ |
| 18 | | | ◎ | ◎ | ◎ | | ◎ | | ◎ |
| 19 | | ◎ | | | ◎ | | | ○ | |
| 20 | | | ◎ | ◎ | ◎ | | ◎ | | ◎ |

◎ Ratio of atom numbers was 5.0% or more.
○ Ratio of atom numbers was from 1.0 to 5.0%.
Δ Ratio of atom numbers was less than 1.0%.

Subsequently, the samples were immersed in a solution containing 20 g/L of hydrochloric acid and were anodically dissolved at a potential of +250 mV relative to the standard hydrogen electrode for 60 seconds. SEM observation of 0.05 $mm^2$ of visual field of a sample surface was carried out at a magnification of 2000 with regard to the pits from 0.5 to 5 μm in size, and at a magnification of 20000 with regard to the pits from 0.01 μm to less than 0.5 μm in size. The number of pits was counted.

The well known photolithography was applied to the alloy strips.

The through-holes for passing an electron beam are formed in the shadow mask by means of the well known photolithography. The photoresist mask is delineated to form a number of apertures in the circular form having 80 μm of diameter on one of the surfaces of the alloy strip and to form a number of apertures in the circular form having 180 μm of diameter on the coincident positions of the other surface of the alloy strip. The aqueous-solution of ferric chloride in the form of spray is blown onto the alloy strip. As a result, ten pieces of the mask materials 14 inches in diameter were produced.

In Table 2, the failure frequency is indicated in terms of the failed sheets in one lot. The pit density is also shown in Table 2.

When there is no failure in the ten sheets of the mask material, this is expressed as Rank 1. One failed sheet is expressed as Rank 2. Two failed sheets is expressed as Rank 3. Four failed sheets is expressed as Rank 4. The mask material expressed as Ranks 1–3 is acceptable, while the mask material expressed as Rank 4 is unacceptable. When pit density is 2000 or more pits/$mm^2$, the frequency of failure falls within Ranks 1–3.

TABLE 2

| Failure Frequency | Pit Density (Pits/$mm^2$) |
|---|---|
| Rank 1 (acceptable) | 17700 |
| Rank 2 (acceptable) | 2600 |
| Rank 3 (acceptable) | 2000 |
| Rank 4 (unacceptable) | 1770 |

Figure 1:
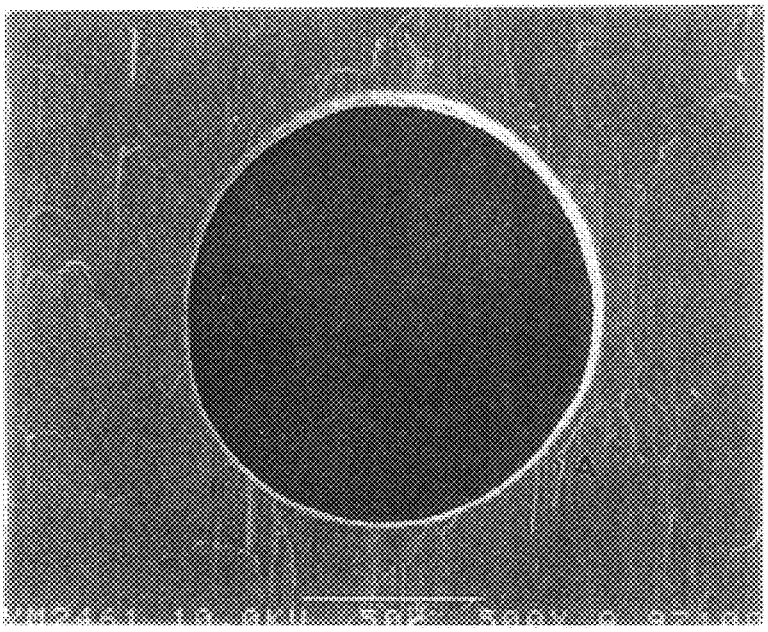
FIG. 1 shows an SEM image of a normal through hole of a shadow mask formed by etching.
Figure 2:
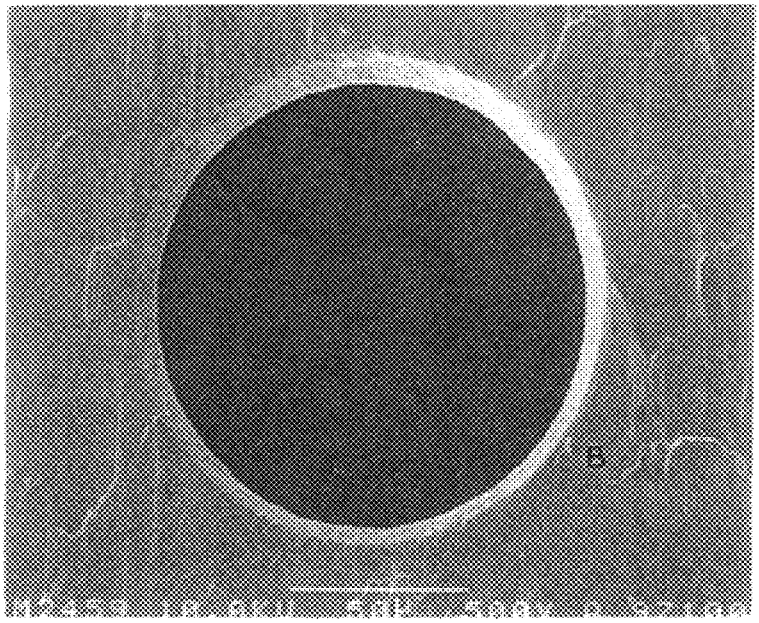
FIG. 2 shows an SEM image of an abnormal through hole of a shadow mask formed by etching.
Figure 3:
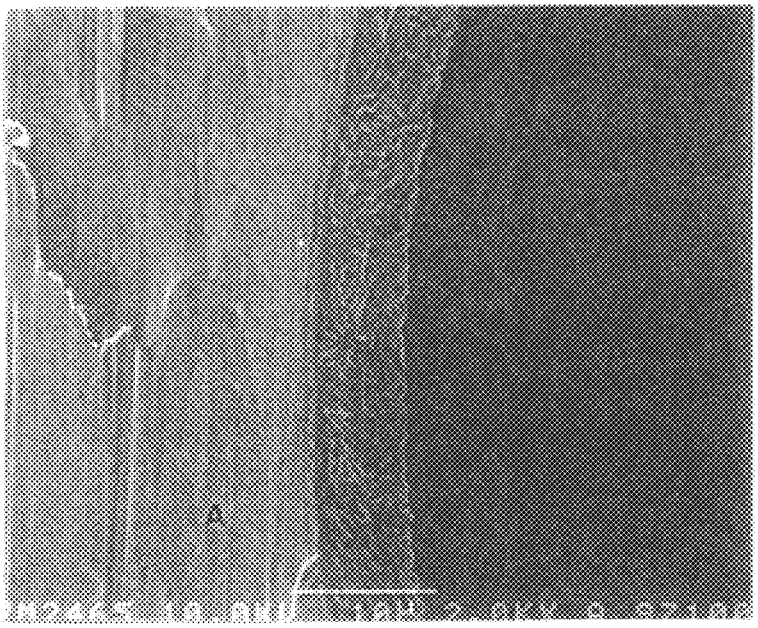
FIG. 3 is an SEM image of the wall part of FIG. 1.
Figure 4:
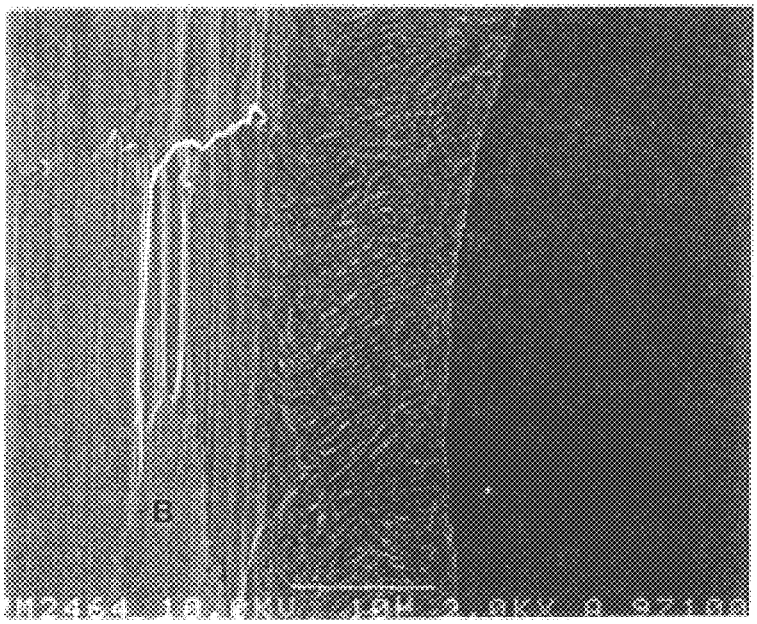
FIG. 4 is an SEM image of the wall part of FIG. 2.

As is described hereinabove, the present invention proposes, from a completely novel point of view, a solution to prevent the diameter variation of the etching though holes. That is, a number of fine inclusions are positively formed in the Fe—Ni alloy material. These fine inclusions contribute to form the through-holes for passing an electron beam having uniform diameter over the entire material used as a mask. In other words, the formation of abnormal through-holes due to local corrosion failure is prevented. Note that the through-holes for passing an electron beam is uniform under the observation of an electron beam as illustrated for example in FIG. 1.

What is claimed is:

1. Material used for a shadow mask having through-holes for passing an electron beam formed by etching, with improved uniformity of diameter, and consisting of an Fe—Ni alloy, which consists of, by mass percentage (%), from 34 to 38% of Ni, not more than 0.5% of Mn, from 5 to 40 ppm of B, from 5 to 40 ppm of N, the balance being Fe and unavoidable and incidental impurities with the proviso of 0.10% or less of C, 0.30% or less of Si, 0.30% or less of Al, 0.005% or less of S, and 0.005% or less of P, characterized in that the precipitates and inclusions, observed by an anodic solution method essentially consist of 2000 or more of precipitates and inclusions from 0.01 $\mu$m to 5 $\mu$m in diameter are varied on the surface of said material per $mm^2$ of said surface, with said anodic solution method comprising subjecting a sample to an anodic solution in an acid solution containing 20 g/L of hydrochloric acid at a potential of 250 mV relative to the standard hydrogen electrode.

2. Material used for a shadow mask having through-holes for passing an electron beam formed by etching, with improved uniformity in the diameter of apertures, and consisting of an Fe—Ni alloy consisting of, by mass percentage (%), from 34 to 38% of Ni, not more than 0.5% of Mn, from 5 to 40 ppm of B, from 5 to 40 ppm of N, the balance being Fe and unavoidable and incidental impurities with the proviso of 0.10% or less of C, 0.30% or less of Si, 0.30% or less of Al, 0.005% or less of S, and 0.005% or less of P, characterized in that, precipitates and inclusions, observed by an anodic solution method essentially consist of 2000 or more of precipitates and inclusions from 0.01 $\mu$m to 5 $\mu$m in diameter are varied on the surface of said material per $mm^2$ of said surface, except for the portions where said through-holes are formed, with said anodic solution method comprising subjecting a sample to an anodic solution in an acid solution containing 20 g/L of hydrochloric acid at a potential of 250 mV relative to the standard hydrogen electrode.

* * * * *